US006710015B2

(12) United States Patent
Kaneko et al.

(10) Patent No.: US 6,710,015 B2
(45) Date of Patent: Mar. 23, 2004

(54) THERMOSENSITIVE RECORDING MATERIAL

(75) Inventors: Yoshikazu Kaneko, Numazu (JP); Yasutomo Mori, Numazu (JP); Mitsuru Naruse, Tagata-gun (JP); Kunio Hayakawa, Mishima (JP); Mitsunobu Morita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 79 days.

(21) Appl. No.: 10/178,770

(22) Filed: Jun. 25, 2002

(65) Prior Publication Data

US 2003/0125205 A1 Jul. 3, 2003

(30) Foreign Application Priority Data

Jun. 25, 2001 (JP) ..... 2001-191820
Jun. 25, 2001 (JP) ..... 2001-191836

(51) Int. Cl.[7] ..... B41M 5/20; B41M 5/24
(52) U.S. Cl. ..... 503/200; 503/207; 503/226
(58) Field of Search ..... 503/200, 207, 503/226

(56) References Cited

U.S. PATENT DOCUMENTS 4,985,394 A * 1/1991 Mori et al. ..... 503/226
5,622,909 A * 4/1997 Furuya et al. ..... 503/216
5,972,836 A * 10/1999 Morita et al. ..... 503/207

FOREIGN PATENT DOCUMENTS

JP 02003080846 A * 3/2003

* cited by examiner

*Primary Examiner*—N. Edwards
(74) *Attorney, Agent, or Firm*—Oblon, Spivak, McClelland, Maier & Neustadt, P.C.

(57) ABSTRACT

A thermosensitive recording material having a support, a thermosensitive recording layer containing a leuco dye and a color developer, and an intermediate layer interposed therebetween. The intermediate layer contains hollow particles having a hollowness of 60 to 98%, a maximum particle diameter (D100) of 5.0 to 10.0 $\mu$m and a ratio D100/D50 of the maximum particle diameter (D100) to the median volume equivalent particle diameter (D50) in the range of 1.5 to 3.0. The hollow particles may be composed of a crosslinked polymer of a chlorine-free vinyl monomer.

16 Claims, No Drawings

THERMOSENSITIVE RECORDING MATERIAL

BACKGROUND OF THE INVENTION

This invention relates generally to a thermosensitive recording material and, more specifically, to a thermosensitive recording material having an intermediate layer (undercoat layer) between a support and a thermosensitive recording layer.

With diversification of information and expansion of needs therefor in recent years, various types of recording materials have been developed and put into practice in the field of information recording. Especially, thermosensitive recording materials are widely used in various fields such as information processing (output of a desk-top calculator, computer or the like), recorder for a medical measurement device, low- or high-speed facsimile, automatic ticket machine (railway ticket, admission ticket or the like), thermal copying machine, label of a POS system, and luggage tag because of the following advantages:

(1) an image can be recorded with ease only by applying heat;

(2) recording can be conducted with a simple mechanism, so that it is possible to downsize the device, and a recording material is easy to handle and inexpensive; and (3) a recording material consists of one component of a thermosensitive paper.

With a trend toward smaller and faster recording devices in recent years, demands for a high sensitive recording material capable of recording with low printing energy of a small-sized, high-speed machine are increasing.

A thermosensitive material is generally produced by applying a thermosensitive coloring liquid containing a coloring component which undergoes a coloring reaction upon application of heat on a support such as a paper or a synthetic resin film and drying the same. By applying heat with a thermal pen or a thermal head, a colored image is formed on the thermosensitive recording material. As known examples, there are thermosensitive materials disclosed in Japanese Laid-Open Patent Publication No. S43-4160 and Japanese Examined Patent Publication No. S45-14039. Such conventional thermosensitive recording materials have low thermal responsiveness and thus cannot obtain a sufficient coloring density in high-speed recording. As a method to overcome the drawback, thermosensitive recording materials having an intermediate layer containing hollow resin particles between a support and a thermosensitive recording layer are disclosed. For example, Japanese Laid-Open Patent Publication No. H01-113282 discloses a method in which spherical hollow particles having a Tg of 40 to 90° C., an average particle diameter of 0.20 to 1.5 $\mu$m, and a hollowness of at least 90% are used. However, this thermosensitive recording material has a drawback that the particles, when softened by the heat from a thermal head in printing, are likely to cause sticking. Also, the hollow particles do not have an effect of improving the sensitivity of the thermosensitive recording material up to a satisfactory level, Japanese Laid-Open Patent Publication No. H04-241987 discloses a thermosensitive recording material having an intermediate layer containing hollow thermoplastic resin particles having an average particle diameter of 2 to 10 $\mu$m and a hollowness of at least 90%. Japanese Laid-Open Patent Publication No. H05-309939 discloses a thermosensitive recording material having an intermediate layer containing hollow particles having a particle diameter in the range of 2 to 20 $\mu$m and a specific gravity of not greater than 0.21. Japanese Laid-Open Patent Publication No. H08-238843 disclosed a thermosensitive recording material having an intermediate layer containing hollow particles having a hollowness of at least 90% and a block copolymer of ethylene oxide and propylene oxide. However, the hollow particles used in the above thermosensitive recording materials include particles with a large diameter of 10 to 30 $\mu$m and, when a thermosensitive recording layer is provided over the intermediate layer containing the particles, no thermosensitive layer is formed on parts where there are the particles of large diameters. This causes white void when a solid image is formed. Also, the hollow particles contain vinylidene chloride, which contains chlorine atoms that can contaminate the environment in incineration disposal of the thermosensitive recording material.

Japanese Laid-open Patent Publication No. H03-147888 disclosed a thermosensitive recording material having an intermediate layer containing hollow particles of a synthetic resin having a hollow volume rate of 35 to 60 vol. % and an average particle diameter of 0.4–1.5 $\mu$m. Japanese Laid-Open Patent Publication No. H02-214688 disclosed a thermosensitive recording material having an intermediate layer mainly composed of non-foamed microhollow particles having a hollowness of at least 30%. However, the particles used in the above thermosensitive materials, which have a low hollowness of not greater than 60%, do not have a sufficient thermal insulating property. Thus, the above thermosensitive recording materials are insufficient in sensitivity. As above, hollow particles having a diameter of not greater than 10 $\mu$m and a hollowness of at least 60% simultaneously have not been realized yet.

There has been proposed a method in which a binder resin is used together with hollow particles in an intermediate layer. For example, Japanese Laid-Open Patent Publication No. H06-247051 proposed the use of 10 to 40%, based on the amount of the hollow particles, of a binder in the intermediate layer. Japanese Laid-Open Patent Publication No. H02-214688 proposes the use of 2 to 50%, based on the amount of the hollow particles, of a binder in the intermediate layer. However, it is known that the rate of the binder is insufficient to improve the sensitivity of the thermosensitive recording material and definition of an image recorded thereon,

SUMMARY OF THE INVENTION

It is, therefore, an object of the present invention to provide a thermosensitive recording material with an intermediate layer containing hollow particles, which has overcome the drawbacks of the prior arts, having high sensitivity and free from a white void and sticking and capable of forming a uniform image.

Another object of the present invention is to provide a thermosensitive recording material having no possibility of environmental contamination in incineration disposal due to chloride.

In accordance with one aspect of the present invention, there is provided a thermosensitive recording material comprising a support, an intermediate layer provided on said support, and a thermosensitive recording layer provided on said intermediate layer and containing a leuco dye and a color developer for developing said leuco dye upon application of heat, wherein said intermediate layer contains a binder and hollow particles made of a crosslinked polymeric material and having a hollowness of not lower than 60% but not higher than 98%, a maximum particle diameter (D100)

of 5.0 to 10.0 μm and a ratio D100/D50 of said maximum particle diameter (D100) to the median volume equivalent particle diameter (50) in the range of 1.5 to 3.0.

In another aspect, the present invention provides a thermosensitive recording material comprising a support, an intermediate layer provided on said support, and a thermosensitive recording layer provided on said intermediate layer and containing a leuco dye and a color developer for developing said leuco dye upon application of heat, wherein said intermediate layer comprises a binder and hollow particles of a crosslinked polymeric material which does not contain a halogen atom, said hollow particles having a hollowness of not lower than 60% but not higher than 98%.

Other objects, features and advantages of the present invention will become apparent from the detailed description of the preferred embodiments to follow.

DETAILED DESCRIPTION OF THE PREFERRED EMBODIMENTS OF THE INVENTION

A thermosensitive recording material according to the present invention comprises a support, an intermediate layer provided on the support and containing hollow particles, and a thermosensitive recording layer provided on the intermediate layer. The thermosensitive recording layer contains a leuco dye and a color developer for developing the leuco dye upon application of heat.

It is preferred that the hollow particles have a maximum particle diameter (D100) of 5–10 μm, more preferably 7 to 10 μm. In the case where the maximum particle diameter is greater than 10 μm, a thermosensitive layer is not efficiently formed at parts where there are particles having such large diameters, when the thermosensitive recording layer is formed on the intermediate layer. This will cause white voids when a solid image is formed. When the maximum particle diameter is smaller than 5 μm, it is not easy for the hollow particles to have a suitable hollowness, resulting in low sensitivity of the thermosensitive recording material.

It is also preferred that the hollow particles have such a particle size characteristics that a ratio D100/D50 of the maximum particle diameter (D100) to the median volume equivalent particle diameter (D50) of 3.0 or less, more preferably 1.5 to 3.0, most preferably 1.5 to 2.7.

When the ratio D100/D50 is greater than 3.0, the hollow particles have a broad particle diameter distribution. In this case, the proportion of fine particles of a diameter not greater than 1 μm in the hollow particles increases so that the hollow particles are not easily distributed in the intermediate layer uniformly. This may result in low sensitivity of the thermosensitive recording material. A D100/D50 ratio of less than 1.5 means that the hollow particles have a very sharp particle diameter distribution. Under present circumstances, it is difficult to synthesize hollow particles having such a sharp particle diameter distribution.

In the hollow particles, the proportion of particles having a diameter of not greater than 2 μm is preferably 10% by volume or less, more preferably in the range of 5–10% by volume. When the content is over 10%, the proportion of fine particles of a diameter not greater than 1 μm increases so that the hollow particles are not easily distributed in the intermediate layer uniformly, which may result in low sensitivity of the thermosensitive recording material. A ratio of 5% or lower means that the hollow particles have a very sharp particle diameter distribution. Under present circumstances, it is difficult to synthesize hollow particles having such a sharp diameter distribution.

The particle diameters as used herein are all measured using a grain size distribution measuring apparatus LA-700, manufactured by Horiba Ltd. The median volume equivalent particle diameter is a diameter corresponding to the 50% mark on the cumulative frequency distribution curve and herein designated as D50. Thus, D50 is the particle size wherein 50% by volume of the particles in the particle size distribution is smaller in diameter. The maximum diameter is the maximum value in the particle diameter distribution and herein designated as D100.

In the present invention, since the hollow particles serve as a thermal insulator and give elasticity to the thermosensitive recording material, thermal energy from a thermal head effectively can be utilized effectively. This improves coloring sensitivity of the thermosensitive recording material. To improve the sensitivity of the thermosensitive recording material, the hollow particles preferably has a hollowness at least 60%, more preferably in the range of 60 to 98%, most preferably 75–95%. When the hollowness is less than 60%, the above effects are small. When the hollowness is over 98%, the thickness of the particle walls is so small that the hollow particles cannot have sufficient strength.

The hollowness of the hollow particles is represented by a percentage of volume of voids in the volume of the hollow particles. The hollow particles can be regarded as almost spherical, the hollowness of the hollow particles can be obtained from the following equation (1).

$$\text{Hollowness}=\{[\text{Volume of voids}]/[\text{Volume of hollow particles}]\}\times 100(\%) \quad (1)$$

For the purpose of the present invention, the hollow particles preferably have a Tg of 95–150° C., more preferably 95–120° C. When the Tg is lower than 95° C., the intermediate layer containing such hollow particles is apt to be fuse-bonded with the thermosensitive coloring layer in printing with a thermal head and causes sticking, making high-quality printing difficult. When the Tg is higher than 150° C., the intermediate layer containing such hollow particles is so stiff in printing with a thermal head that the thermosensitive recording material cannot be brought into close contact with the thermal head, resulting in low sensitivity of the thermosensitive recording material. Thus, the Tg of the hollow particles is preferably in the range of 95–150° C.

As described above, when hollow particles contained in the intermediate layer have (a) a hollowness of 60 to 98%, (b) a maximum diameter (D100) of 5 to 10 μm (c) a ratio D100/D50 of the maximum diameter (D100) to the diameter corresponding to the 50% mark on the cumulative frequency distribution curve (D50) of 1.5 to 3.0, (d) a content of particles of a diameter of not greater than 2 μm, more preferably in the range of 5–10%, and (e) a Tg of in the range of 95–150° C., the thermosensitive recording material has an improved thermal insulating property and can be brought into close contact with a thermal head. Thereby, heat from the thermal head is efficiently transmitted to a surface of the thermosensitive recording material, so that the sensitivity of the thermosensitive recording material is enhanced. The hollow particles also has an effect of maintaining the surface of the thermosensitive recording material uniform, so that white voids and sticking are prevented and uniformity of a printed image is improved.

Various methods of preparing hollow particles have been proposed. In the present invention, the hollow particles are generally prepared by a method comprising the steps of preparing capsule particles each having a shell of a thermoplastic polymer in which a volatile material such as isobutane is contained as a core, and heating the particles to allow the thermoplastic polymer to foam. To ensure a hollowness of at least 60% by this method, the shell of the capsule needs to have low permeability. Vinylidene chloride can lower the permeability of the shell and thus effective to ensure a high hollowness of the hollow particles. However, chlorine atoms contained in vinylidene chloride may cause environmental problems when the thermosensitive recording material is incinerated.

As a result of zealous studies for a method of preparing the shells of the capsule particles with a material free from chlorine, the present inventors have found that, when a polymeric material having a crosslinked structure is used in place of vinylidene chloride, it is possible to obtain the same effect as that obtained when vinylidene chloride is used. Shells made of a vinyl polymer alone easily rupture upon application of heat, making it difficult to ensure a high hollowness. However, when a polymeric material having a crosslinked structure is used, the shells do not rupture under application of heat, ensuring a hollowness as high as 60% or more of the hollow particles.

The crosslinked polymeric material which does not contain a halogen atom, particularly a chlorine atom, may be a homopolymer or a copolymer such as a random copolymer, a block copolymer or a graft copolymer. One preferred crosslinked polymeric material is a crosslinked polymer or copolymer of a vinyl monomer. In particular, the crosslinked polymeric material is preferably a copolymer of (a) at least one monofunctional vinyl monomer and (b) at least one polyfunctional vinyl monomer. The monofunctional vinyl monomer has one vinyl group, while the polyfunctional vinyl monomer has at least two, preferably 2 to 3 vinyl groups.

The polyfunctional vinyl monomer which serves as a crosslinking agent in the present invention may be selected from those conventionally used. Typical examples of the polyfunctional vinyl monomer (crosslinking agent) include divinylated aromatic hydrocarbons such as divinyl benzene and divinyltoluene; polyethylene glycol di(meth)acrylates such as diethylene glycol di(meth)acrylate and triethylene glycol di(meth)acrylate; polypropylene glycol di(meth) acrylates such as dipropylene glycol di(meth)acrylate and tripropylene glycol di(meth)acrylate; alkylene glycol di(meth)acrylates such as 1,3-butylene glycol di(meth) acrylate, 1,6-hexaglycol di(meth)acrylate, neopentyl glycol di(meth)acrylate; 2,2'-bis (4-acryloxydiethoxyphenyl) propane; trimethylolpropane tri(meth)acrylate; and diallyl phthalate. The term (meth)acrylate as used herein is intended to refer to methacrylate and acrylate. These polyfunctional vinyl monomer are free from halogen atoms, especially chloride atoms, and thus cause no environmental contamination even when combusted. Especially preferred polyfunctional vinyl monomer is divinylbenzene.

In the present invention, the crosslinking agent is preferably used in such an amount as to provide a crosslinking degree of 0.1 to 10%, more preferably 1 to 3%, The crosslinking degree as used herein is defined as follows:

$$R=B/(A+B)\times 100(\%)$$

in which R is the crosslinking degree, A is the moles of the monofunctional vinyl monomer and B is the crosslinking equivalent moles of the polyfunctional vinyl monomer (crosslinking agent). Namely, B is obtained by multiplying the moles of the crosslinking agent by a half number of the vinyl groups and is, for example, 4.5 when 3 moles of trivinyl compound is used (B=M×n/2 in which M is the moles of the crosslinking agent and n is the number of the vinyl groups).

Any conventionally used monofunctional vinyl monomer may be used for the purpose of the present invention. Illustrative of suitable monofunctional vinyl monomers are nitrile-type vinyl monomers such as acrylonitrile and methacrylonitrile; (meth)acrylic ester-type vinyl monomers such as acrylates and methacrylates; olefin-type vinyl monomers such as ethylene and propylene; styrene-type vinyl monomers such as styrene and its homologues (substituted styrenes having one or more substitutents such as methyl and ethyl); and vinyl acetate. The monofunctional vinyl monomer is preferably selected from acrylonitrile, methacrylonitrile, an acrylic ester and a methacrylic ester.

The monofunctional vinyl monomer is also preferably a (meth)acrylate represented by the following formula (1):

(1)

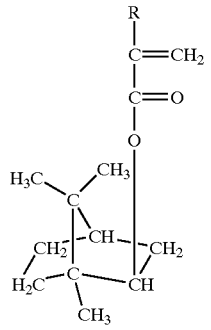

wherein R represents a hydrogen or a methyl group.

When the (meth)acrylate of the above formula (1) is used as the monofunctional vinyl monomer, the crosslinked polymeric material has a skeletal structure containing a structural unit represented by the following general formula (2);

(2)

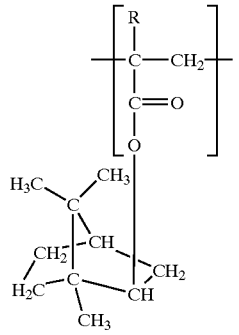

wherein R represents a hydrogen or a methyl group.

The present inventors have found that a copolymer containing the (meth)acrylic ester represented by the formula (2) as the structural unit thereof has an effect of making the particle diameter distribution of the hollow particles sharp such that the ratio D100/D50 of the maximum diameter (D100) to the diameter corresponding to the 50% mark on the cumulative frequency distribution curve (D50) is 1.5 to 3.0. The (meth)acrylic ester represented by the formula (2) is preferably present in the polymer in an amount of 10 to 70 mole %, more preferably 10 to 40 mole %, based on the total moles of the monomer units contained therein.

The intermediate layer may be provided over the support by the method comprising the steps of dispersing the hollow particles together with a liquid containing a binder such as a water-soluble polymer, an aqueous emulsion of a hydrophobic polymer or a mixture thereof to prepare an intermediate layer coating liquid, applying the coating liquid on the support and drying the same. The intermediate layer is preferably applied on the support in an amount of 1–5 g/m$^2$ on a dry basis. After drying, the intermediate layer is overlaid with the heat sensitive recording layer.

That surface of the intermediate layer which provides an interface between the intermediate layer and the thermosensitive layer preferably has a printing roughness Rp of in the range of 0.1–5.0 $\mu$m. When the Rp value is greater than 5 $\mu$m, the surface roughness becomes so large under pressure that the thermosensitive recording material may not be sufficiently brought into close contact with a thermal head in printing, resulting in lowering of sensitivity of the thermosensitive recording material and definition of the printed image. When the Rp value is not greater than 0.1 $\mu$m, the surface roughness under pressure is so excessively small that the thermosensitive recording material may not be brought into too close contact with the thermal head and causes conveyance failure thereof.

The printing roughness Rp, which represents a surface smoothness under a dynamic pressing condition, is described in detail in, for example, "A METHOD TO MEASURE SURFACE SMOOTHNESS OF PAPER BY OPTICAL CONTACT METHOD" by S. Sakuramoto, Laboratory Report of the Printing Bureau of the Finance Ministry of Japan, Vol. 29, no. 9, pp 615–622(1977) or "AN OPTICAL METHOD FOR EVALUATING PRINTING SMOOTHNESS OF PAPER", Nippon Insatsu Gakkai Ronbun-shu (Japan Printing Association Theses), 15, [4], p. 87–94 (1975), and is measured by an optical dynamic print smoothness measuring apparatus called MICROTOPOGRAPH (manufactured by Toyo Seiki Co., Tokyo, Japan) using a prism as a measuring medium under a pressure of 1 Kg/cm$^2$. The printing roughness Rp is proportional to an average depth of depressions formed on a surface of the intermediate layer when dynamically pressed against a flat surface of a prism at a pressure of 1 kg/cm$^2$.

The binder for the intermediate layer may be a water-soluble polymer or a water-insoluble polymer (hydrophobic polymer) or a mixture thereof. For the preparation of an intermediate layer-forming liquid, the water-soluble polymer is generally used as an aqueous solution, while the hydrophobic polymer is generally used as an aqueous emulsion or dispersion. The amount of the binder is such that the weight ratio (B/A) of the hollow particles (B) to the binder (A) is generally 1:1 to 3:1, preferably 1:1 to 2:1.

Typical examples of the water-soluble polymer include starch and its derivatives; cellulose derivatives such as methoxy cellulose, hydroxyethyl cellulose, carboxymethyl cellulose, methyl cellulose, and ethyl cellulose; sodium polyacrylate, polyvinylpyrrolidone, acrylamide-acrylate copolymer, alkali salts of styrene-maleic anhydride copolymer, alkali salts of isobutylene-maleic anhydride copolymer, polyacrylamide, sodium alginate, gelatin, casein.

As the polyvinyl alcohol for use in the intermediate layer, various types of modified polyvinyl alcohol, such as completely saponified polyvinyl alcohol, carboxyl-modified polyvinyl alcohol, partially saponified polyvinyl alcohol, sulfonic acid-modified polyvinyl alcohol, silyl-modified polyvinyl alcohol, acetoacetyl-modified polyvinyl alcohol, and diacetone-modified polyvinyl alcohol, can be used. Especially preferred is the use of completely saponified polyvinyl alcohol.

As the hydrophobic polymer for use in the intermediate layer, there may be mentioned a styrene-acrylic ester copolymer resin, an acrylic ester resin, a polyurethane resin, a styrene/butadiene copolymer resin, a styrene/butadiene/acrylic ester terpolymer resin, a polyvinyl acetate resin, and a vinyl acetate/acrylic acid copolymer resin. These resins may be preferably used in the form of an aqueous emulsion. A latex of a styrene/butadiene copolymer is particularly preferably used.

It is preferred that the hydrophobic polymer resin as a binder for the intermediate layer be used in an amount of 100–300%, more preferably 100–200%, based on the weight of the hollow particle for reasons of improved sensitivity of the thermosensitive recording material. This is believed to be because the hydrophobic resin can fill the spaces among the particles to improve the smoothness of the surface of the intermediate layer. When the hydrophobic resin is used in an amount smaller than 100% based on the weight of the hollow particles, spaces remain among the hollow particles, resulting in failure to increase the coloring density of the thermosensitive recording material. When the hydrophobic resin is used in an amount over 300% based on the weight of the hollow particles, the proportion of the hollow particles in the intermediate layer will be so small that the thermal insulating property of the intermediate layer is lowered, resulting in lowering of the sensitivity of the thermosensitive recording material.

It is also preferred that the hydrophobic polymer resin be used in conjunction with a polyvinyl alcohol resin. The amount of the polyvinyl alcohol resin is generally 1–30%, preferably 1–10%, based on the weight of the hollow particles. When the hydrophobic polymer resin is used in conjunction with a polyvinyl alcohol resin, the film formability of the intermediate layer coating liquid and wettability of a thermosensitive recording layer coating liquid to the intermediate layer are improved. Thus, the addition of polyvinyl alcohol has an effect of enhancing the definition of the printed image. When the poly vinyl alcohol is used in an amount smaller than 1%, the effect of enhancing the definition of the printed image cannot be expected. When the polyvinyl alcohol is used in an amount over 30%, the viscosity of the intermediate layer coating liquid is increased, making it difficult to apply the coating liquid uniformly. The amount of polyvinyl alcohol is preferably 0.3 to 10 parts by weight, more preferably 3 to 6 parts by weight, per 100 parts by weight of the hydrophobic polymer resin.

An alkali thickener may be added in the intermediate layer to improve the head matching property of the thermosensitive recording material. An alkali thickener is a binder whose velocity increases under alkali conditions. A typical example of the alkali thickener is en emulsion latex mainly composed of styrene-butadiene copolymer. In the present invention, the alkali thickener may be used alone. However, in order to allow the binder component to be stably present as dispersed particles, it is preferred to user for example, a carboxylated latex that is a polymer of an unsaturated carboxylic acid together with the alkali thickener. With an increase of pH, a highly carboxylated polymer in an area adjacent to the particle surfaces of the carboxylated latex is dissolved in water to increase the viscosity of the coating liquid, further enhancing the thickening property of the binder.

In the intermediate layer of the present invention constituted as above, the hollow particles have improved dispersion stability. Thus, in the present invention, it is unnecessary to add a thickener generally used in a coating liquid of this type, such as sodium montmorillonite or a modified poly acrylic acid, to the intermediate coating liquid. An alkali thickener also has an effect of fixing the hollow particles tightly in addition to the thickening effect, the matching property of the thermosensitive recording material with a thermal head is considerably improved. The alkali thickener is added in an amount of 1 to 80 parts, preferably 5 to 50 parts, per 100 parts of the hollow particles. The binder is preferably a styrene-butadiene copolymer but is not limited thereto as long as it is capable of being thickened under alkali conditions. In order to maintain the coating liquid alkaline, a pH adjuster is necessary. Typical example of the pa adjuster is ammoniacal water but other pH adjusters may be also used unless they inhibit the coloring of the thermosensitive coloring layer.

The intermediate layer may contain, in addition to the hollow particles and the alkali thickening binder, supplemental components generally used in thermosensitive recording materials of this type, such as a filler, a thermofusible material and an surfactant, as desired. In order to apply the intermediate layer coating liquid uniformly and rapidly, the viscosity of 20% aqueous dispersion of the hollow particles at 20° C. is preferably not greater than 200 mPa·s. When this viscosity is over 200 mPa·s, the viscosity of the coating liquid prepared as above becomes high and may cause coating unevenness. In order to make the surface of the intermediate layer smoother, the surface of the intermediate layer may be subjected to calender treatment.

In the thermosensitive coloring layer of the present invention, leuco dyes are used alone or in combination as a coloring agent. Any leuco dye generally used in thermosensitive recording materials of this type, such as triphenylmethane type leuco compounds, fluoran type leuco compounds, phenothiazine type leuco compounds, auramine type leuco compounds, spiropyran type leuco compounds, and indolinophthalide type leuco compounds can be employed. Specific examples of such leuco dyes include 3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dibutylaminophenyl)phthalide,
3-dimethylamino-5,7-dimethylfluoran,
3-diethylamino-7-methylfluoran,
3-diethylamino-7,8-benzfluoran,
3-(N-p-tolyl-N-ethylamino)-6-methyl-7-anilinofluoran,
3-pyrrolidino-6-methyl-7-anilinofluoran,
3-N-methyl-N-n-amylamino-6-methyl-7-anilinofluoran,
3-N-methyl-N-cyclohexylamino-6-methyl-7-anilinofluoran,
3-diethylamino-6-methyl-7-anilinofluoran,
3-(N, N-diethylamino)-5-methyl-7-(N,N-dibenzyl-amino) fluoran,
benzoyl leuco methylene blue,
3-(2'-hydroxy-4'-dimethylaminophenyl)-3-(2'-methoxy-5'-nitrophenyl)phthalide,
3-(7'-hydroxy-4'-diethylaminophenyl)-3-(7'-methoxy-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-N-methyl-N-isobutyl-6-methyl-7-anilinofluoran,
3-morphorino-7-(N-propyl-trifluoromethylanilino)fluoran,
3-(N-ethyl-p-toluidino)-7-(α-phenylethylamino) fluoran,
3-diethylamino-7-(o-methoxycarbonylphenylamino) fluoran,
3-diethylamino-5-methyl-7-(α-phenylethylamino)fluoran,
3-diethylamino-7-piperidinofluoran,
3-di-n-butylamino-6-methyl-7-anilinofluoran,
3,6-bis(dimethylamino)fluorenespiro(9,3')-6'-dimethylaminophthalide,
3-diethylamino-6-methyl-7-mesidino-4',5'-benzofluoran,
3-N-methyl-N-isopropyl-6-methyl-7-anilinofluoran,
3-N-ethyl-N-isoamyl-6-methyl-7-anilinofluoran,
3-diethylamino-6-methyl-7-(2',4'-dimethylanilino)fluoran,
3-morpholino-7-(N-propyl-trifluoromethylanilino) fluoran,
3-(N-ethyl-p-toluidino)-7-(α-phenylethylamino)fluoran,
3-diethylamino-7-(o-methoxycarbonylphenylamino) fluoran,
3-diethylamino-5-methyl-7-(α-phenylethylamino)fluoran,
3-diethylamino-7-piperidinofluoran,
3,6-bis (dimethylamino) fluorenespiro (9,3')-6'-dimethylaiminophthalide,
3-(N-benzyl-N-cyclohexylamino)-5,6-benzo-7-α-naphthylamino-4'-bromofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesidino-4',5'-benzofluoran,
3-(p-dimethylaminophenyl)-3-{1,1-bis(p-dimethylaminophenyl)ethylene-2-yl}phthalide,
3-(p-dimethylaminophenyl)-3-{1,1-bis(p-dimethylaminophenyl)ethylene-2-yl}-6-dimethylaminophthalide,
3-(p-dimethylaminophenyl)-3-(1-p-dimethylaminophenyl-1-phenylethylene-2-yl)phthalide,
3-(4'-dimethylamino-2'-benzyloxy)-3-(1"-p-dimethylaminophenyl-1"-phenyl-1",3"-butadiene-4"-yl) benzophthalide,
3-dimethylamino-6-dimethylamino-fluoren-9-spiro-3'-(6'-dimethylamino)phthalide,
bis(p-dimethylaminostyryl)-1-naphthalenesulfonylmethane, and
bis(p-dimethylaminostyryl)-1-p-tolylsulfonylmethane.

Above all, 3-(N,N-dibutylamino)-6-methyl-7-anilinofluoran, 3-(N-ethyl-N-isoamylamino)-6-methyl-7-anilinofluoran, or 3-[N-ethyl-N-(p-methylphenyl)]-6-methyl-7-anilinofluoran is preferred from the viewpoint of coloring property and so on.

In the thermosensitive coloring layer of the present invention, a variety of electron-accepting compounds or oxidants are used as a color developer for developing the leuco dye when coming in contact therewith under application of heat. Such materials are well-known and specific examples thereof include but are not limited to 4,4'-isopropylidenebisphenol,
4,4'-isopropylidenebis(o-methylphenol),
4,4'-sec-butylidenebisphenol,
4,4'-isopropylidenebis(2-tert-butylphenol), zinc p-nitrobenzoate,
1,3,5-tris(4-tert-butyl-3-hydroxy-2,6-dimethyl-benzyl) isocyanuric acid,
2,2-(3,4'-dihydroxydiphenyl)propane,
bis(4-hydroxy-3-methylphenyl)sulfide,
4-{β-(p-methoxyphenoxy)ethoxy}salicylic acid,
1,7-bis(4-hydroxyphenylthio)-3,5-dioxaheptane,
1,5-bis(4-hydroxyphenylthio)-5-oxapentane,
monocalcium salt of monobenzyl phthalate,
4,4'-cyclohexylidenediphenol,
2,2'-methylenebis(4-methyl-6-tert-butylphenol),
4,4'-butylidenebis(6-tert-butyl-2-methyl)phenol,
1,1,3-tris (2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methyl)phenol,
4,4'-diphenolsulfone,
4-isopropoxy-4'-hydroxydiphenylsulfone,
4-benzyloxy-4'-hydroxydiphenylsulfone, 4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)-propane,
N,N'-diphenylthiourea,
N,N'-di(m-chlorophenyl)thiourea,
salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
2,2'-diallyl-4,4'-diphenolsulfone,
3,4-dihydroxyphenyl-4'-methyldiphenylsulfone,
zinc 1-acetyloxy-2-naphthoate,
zinc 2-acetyloxy-1-naphthoate,
zinc 2-acetyloxy-3-naphthoate,
α, α-bis (4-hydroxyphenyl)-α-methyltoluene,
antipyrine complex of zinc thiocyanate, and
4,4'-thiobis(2-methylphenol)

Especially preferred is the use of 4,4-dihydroxydiphenylsulfone, 2,4-dihydroxydiphenylsulfonet 4-isopropoxy-4'-hydroxydiphenylsulfone from the viewpoint of sensitivity and preservability. In the thermosensitive recording material of the present invention, the color developer is used in an amount of 1–20 parts by weight, preferably 2–10 parts by weight, per 1 part of the coloring agent. The coloring agents may be used alone or in combination. The color developers may also be used alone or in combination.

In producing the thermosensitive recording material of the present invention, a binder can be used in the thermosensitive coloring layer for securely fixing the leuco dye and the color developer on a support. Specific examples of the binder include polyvinyl alcohol; starch and its derivatives; cellulose derivatives such as hydroxymethyl cellulose, hydroxyethyl cellulose, carboxymethyl cellulose, methyl cellulose, and ethyl cellulose; water-soluble polymers such as sodium polyacrylate, polyvinylpyrrolidone, acrylamide-acrylate copolymer, acrylamide-acrylate-methacrylic acid terpolymer, alkali metal salts of styrene-maleic anhydride copolymer, alkali metal salts of isobutylene-maleic anhydride copolymer, polyacrylamide, sodium alginate, gelatin, and casein; an emulsion of a resin such as polyvinyl acetate, polyurethane, polyacrylic acid, polyacrylate, vinyl chloride-vinyl acetate copolymer, polybutyl methacrylate and ethylene-vinyl acetate copolymer; and a latex such as styrene-butadiene copolymer, and styrene-butadiene-acryl terpolymer.

The thermosensitive recording material of the present invention may contain a thermofusible material as a thermosensitivity improving agent. Specific examples of the thermofusible material include but are not limited to fatty acids such as stearic acid and behenic acid; fatty acid amides such as stearic acid amide and palmitic acid amide; fatty acid metal salts such as zinc stearate, aluminum stearate, calcium stearate, zinc palmitate and zinc behenate; p-benzylbiphenyl, terphenyl, triphenyl methane, benzyl p-benzyloxybenzoate, β-benzyloxynatphthalene, phenyl P-naphthoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio)ethane, dibenzoylmethane, 1,4-diphenylthiobutane, 1,4-diphenylthio-2-butene, 1.3-bis(2-vinyloxyethoxy) benzene, 1,4-bis(2-vinyloxyethoxy) benzene, p-(2-vinyloxyethoxy)biphenyl, p-aryloxybiphenyl, p-propagyloxybiphenyl, dibenzoyloxymethane, dibenzoyloxypropane, dibenzyldisulfide, 1,1-diphenylethanol, 1,1-diphenylpropanol, p-benzyloxybenzylalcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, dibenzyl oxalate and bis(4-methylbenzyl) oxalate.

The thermosensitive recording layer is formed by a method comprising the steps of uniformly dispersing or dissolving a coloring agent in water or an organic solvent together with a color developer, a binder and so on to prepare a thermosensitive recording layer coating liquid, applying the coating liquid over a support and drying the same. The method of coating is not specifically limited. The thermosensitive recording layer coating liquid preferably has a dispersion diameter of not greater than 5 μm, more preferably not greater than 1 μm. The thickness of the thermosensitive recording layer is in the order of 1–50 μm preferably in the order of 3–20 μm, although it depends on the composition of the thermosensitive recording layer and the usage of the resulting thermosensitive recording material. The thermosensitive recording layer coating liquid may contain various additives generally used in production of thermosensitive recording material for the purpose of improving recording characteristics, as desired.

The support for use in the thermosensitive recording material of the present invention may be a paper, a release paper or a film. The paper may be either an acid paper or a neutralized paper. When a neutralized paper support or a release paper of a neutralized paper is employed, the calcium content thereof is preferably low. A neutralized paper having a low calcium content is obtained by reducing a proportion of old paper used in paper making. In general, calcium carbonate is used as an internal additive and alkylketene dimer, alkenylsuccinic anhydride or the like is used as a sizing agent in paper making. A neutralized paper having a low calcium content can be also obtained when talc or silica is used as the internal additive in place of calcium carbonate together with a neutral rosin sizing agent.

The method of recording on the thermosensitive recording material of the present invention is not specifically limited. The recording may be conducted with a heat pen, a thermal head or by laser heating or the like depending upon the usage of the thermosensitive recording material.

The following examples and comparative examples will further describe the present invention in detail. "Parts" and "%" are both by weight. Hollow particles used in the examples and comparative examples are as follows.

Hollow Particles

The composition, hollowness, maximum particle diameter (D100), ratio D100/D50 of the maximum diameter (D100) to the diameter corresponding to the 50% mark on the cumulative frequency distribution curve (D50), and content of particles of a diameter of not greater than 2 μm of the hollow particles used in Examples and Comparative Examples are summarized in Table 1.

TABLE 1

Physical Properties of Hollow Particles

| Particles | Composition | Hollowness (%) | D100 (μm) | D100/D50 | Content* (%) | Chlorine atom |
|---|---|---|---|---|---|---|
| 1 | MMA/AN/DVB | 80 | 9.0 | 2.1 | 2.2 | Not contained |
| 2 | MMA/AN/MAN/DVB | 90 | 9.8 | 2.7 | 2.6 | Not contained |
| 3 | MMA/AN/I (R = H)/PEDM | 86 | 7.3 | 1.5 | 2.3 | Not contained |
| 4 | MMA/AN/I (R = H)/PEDM | 95 | 8.6 | 1.6 | 2.4 | Not contained |
| 5 | ST/BA | 50 | 5.2 | 4.3 | 15.1 | Not contained |
| 6 | MMAST/BA | 55 | 12.0 | 1.4 | 12.1 | Not contained |
| 7 | MMA/AN/I (R = H)/PEDM | 89 | 10.0 | 2.2 | 2.2 | Not contained |
| 8 | MMA/AN/I (R = H)/PEDM | 91 | 9.0 | 2.0 | 2.6 | Not contained |
| 9 | MMA/AN/I (R = H)/PEDM | 90 | 9.0 | 2.1 | 2.9 | Not contained |
| 10 | MMA/AN/I (R = H)/PEDM | 89 | 10.0 | 3.2 | 21.0 | Not contained |
| 11 | MMA/VC/AN | 89 | 15.0 | 3.8 | 18.2 | Contained |
| 12 | MMA/AN/I (R = H)/PEDM | 91 | 10.0 | 2.9 | 18.2 | Not contained |
| 13 | MMA/AN/I (R = H)/PEDM | 85 | 10.0 | 3.5 | 9.5 | Not contained |
| 14 | MMA/BA/DVB | 75 | 10.0 | 2.3 | 2.4 | Not contained |
| 15 | MMA/AN/EGDMA | 80 | 10.0 | 2.1 | 2.8 | Not contained |
| 16 | MMA/AN/MAN/EGDMA | 90 | 10.0 | 2.2 | 3.5 | Not contained |
| 17 | MMA/AN/EGDME/I (R = H) | 90 | 10.0 | 2.4 | 3.2 | Not contained |
| 18 | MMA/AN/MPTMA/I (R = $CH_3$) | 95 | 10.0 | 2.6 | 3.6 | Not contained |

*Content of particles of not greater than 2 μm (%)
In Table 1, abbreviations are as follows:
MMA: methyl methacrylate
ST: styrene
BA: butyl acrylate
AN: acrylonitrile
MAN: methacrylnitrile
VC: vinylidene chloride
DVB: divinylbenzene
PEDM: polyethylene glycol dimethacrylate
EGDMA: diethylene glycol diacrylate
MPTMA: trimethylolpropane trimethacrylate,
I: Copolymer containing monomer unit of the formula (1)

EXAMPLE 1

Preparation of Coating Liquids

The following intermediate layer coating liquid, thermosensitive recording layer coating liquid, overcoat layer coating liquid and backcoat layer coating liquid were prepared.

(I) Preparation of Intermediate Layer Coating Liquid

| (Liquid A) | |
|---|---|
| Aqueous dispersion of hollow particles (hollow particle 1 in Table 1, solid content: 30%) | 30 parts |

-continued

| (Liquid A) | |
|---|---|
| Styrene/butadiene copolymer latex (solid content: 47.5%) | 20 parts |
| Water | 50 parts |

A mixture of the above ingredients was stirred and dispersed to prepare an intermediate layer coating liquid.

(II) Preparation of Thermosensitive Recording Layer Coating Liquid

| | |
|---|---|
| (Liquid B) | |
| 3-dibutylamino-6-methyl-N-7-anilinofluoran | 20 parts |
| 10% Aqueous solution of polyvinyl alcohol | 20 parts |
| Water | 60 parts |
| (Liquid C) | |
| 4-isopropoxy-4'-hydroxydiphenylsulfone | 20 parts |
| 10% Aqueous solution of polyvinyl alcohol | 25 parts |
| Water | 55 parts |
| (Liquid D) | |
| Silica | 20 parts |
| 5% Aqueous solution of methyl cellulose | 20 parts |
| Water | 60 parts |

A mixture of the above ingredients was pulverized in a magnetic boll mill for 2 days to prepare Liquid B, Liquid C, and Liquid D.

| Thermosensitive recording layer coating liquid | |
|---|---|
| Liquid B | 15 parts |
| Liquid C | 45 parts |
| Liquid D | 45 parts |
| 20% Aqueous alkali solution of isobutylene/maleic anhydride copolymer | 5 parts |

A mixture of the above ingredients was stirred to prepare a thermosensitive recording layer coating liquid.

(III) Preparation of Overcoat Layer Coating Liquid

| (Liquid E) | |
|---|---|
| Aluminum hydroxide | 20 parts |
| 10 Aqueous solution of polyvinyl alcohol | 20 parts |
| Water | 60 parts |

A mixture of the above ingredients was pulverized in a magnetic boll mill for 2 days to prepare Liquid B.

Liquid A prepared as above was applied over a support into a deposition amount of 3.0 g/$m^2$ and dried to obtain a sample having an intermediate layer. In the pressure range of 1.0–2.2 kg/$m^2$, an average depth Rp (printing roughness) of depressions formed in the surface of the intermediate layer was continuously measured using Microtopograph, manufactured by Toyo Seiki Co., whereby the Rp value of the intermediate layer at a pressure of a pressure of 1.0 kg/$cm^3$ was obtained.

The intermediate layer coating liquid prepared as above was applied over a support into a deposition amount of 3.0 g/$m^2$ on a dry basis and dried to form an intermediate layer. Over the intermediate layer, the thermosensitive recording layer coating liquid was applied into a deposition amount of 0.45 g/$m^2$ on a dry basis and dried to form a thermosensitive recording layer. Over the thermosensitive recording layer, the overcoat layer coating liquid was applied such that the deposition amount of the resin (polyvinyl alcohol) was 1.6 $kg/m^2$ on a dry basis and dried. The surface of the overcoat layer was subjected to a surface treatment by a super calender, thereby obtaining a thermosensitive recording material of the present invention.

EXAMPLE 2

A thermosensitive recording material was obtained in the same manner as in Example 1 except that the hollow particles 2 in Table 1 were used in Liquid A in place of the hollow particles 1 in Table 1.

EXAMPLE 3

A thermosensitive recording material was obtained in the same manner as in Example 1 except that the hollow particles 3 in Table 1 were used in Liquid A in place of the hollow particles 1 in Table 1.

EXAMPLE 4

A thermosensitive recording material was obtained in the same manner as in Example 1 except that the hollow particles 4 in Table 1 were used in Liquid A in place of the hollow particle 1 in Table 1.

EXAMPLE 5

A thermosensitive recording material was obtained in the same manner as in Example 1 except that the hollow particles 7 in Table 1 were used in Liquid A in place of the hollow particle 1 in Table 1.

EXAMPLE 6

A thermosensitive recording material was obtained in the same manner as in Example 1 except that the hollow particles 8 in Table 1 were used in Liquid A in place of the hollow particle 1 in Table 1.

EXAMPLE 7

A thermosensitive recording material was obtained in the same manner as in Example 1 except that the hollow particles 9 in Table 1 were used in Liquid A in place of the hollow particle 1 in Table 1.

EXAMPLE 8

A thermosensitive recording material was obtained in the same manner as in Example 1 except that the hollow particles 12 in Table 1 were used in Liquid A in place of the hollow particle 1 in Table 1.

EXAMPLE 9

A thermosensitive recording material was obtained in the same manner as in Example 1 except that the hollow particles 14 in Table 1 were used in Liquid A in place of the hollow particle 1 in Table 1.

EXAMPLE 10

A thermosensitive recording material was obtained in the same manner as in Example 1 except that the hollow particles 15 in Table 1 were used in Liquid A in place of the hollow particle 1 in Table 1.

EXAMPLE 11

A thermosensitive recording material was obtained in the same manner as in Example 1 except that the hollow particles 16 in Table 1 were used in Liquid A in place of the hollow particle 1 in Table 1.

EXAMPLE 12

A thermosensitive recording material was obtained in the same manner as in Example 1 except that the hollow particles 17 in Table 1 were used in Liquid A in place of the hollow particle 1 in Table 1.

EXAMPLE 13

A thermosensitive recording material was obtained in the same manner as in Example 1 except that the hollow particles 18 in Table 1 were used in Liquid A in place of the hollow particle 1 in Table 1.

Comparative Example 1

A thermosensitive recording material was obtained in the same manner as in Example 1 except that the hollow particles 5 in Table 1 were used in Liquid A in place of the hollow particle 1 in Table 1.

Comparative Example 2

A thermosensitive recording material was obtained in the same manner as in Example 1 except that the hollow particles 6 in Table 1 were used in Liquid A in place of the hollow particle 1 in Table 1.

Comparative Example 3

A thermosensitive recording material was obtained in the same manner as in Example 1 except that the hollow particles 11 in Table 1 were used in Liquid A in place of the hollow particle 1 in Table 1.

Evaluation Method

1. Sensitivity Magnitude

Using a thermosensitive recording apparatus (test machine, manufactured by Ricoh Company Ltd) modified using a thin film head manufactured by Matsushita Electronic Component Co., Ltd., printing was performed on the thermosensitive recording material having a calendered surface under conditions of a head power of 0.45W/dot, a recording time per line of 20 sec/L, and a scanning density of 8×385 dots/mm while changing the pulse width in the range of 0.0–0.7 msec every 1 msec. The density of the printed image was measured with a densitometer RD-914, and the pulse width corresponding to a density of 1.0 was calculated. The sensitivity magnitude was calculated according to the following equation, with reference to the value of Comparative Example 1. The larger the value, the better the sensitivity (thermal responsiveness).

Sensitivity magnitude=(pulse width of measured sample)/(pulse width of Comparative Example 1)

2. White voids

The thermosensitive recording material having a calendered surface was heated at 200° C. for 3 seconds using a heat stamper to develop the color. Then, the printed image was checked for white voids with naked eyes.

A: No white voids were observed.

B: White voids were slightly observed.

C: White voids were significantly observed.

3. Sticking

The level of sticking was judged by the printing sound at the time of the sensitivity magnitude test and visual observation of the printed image obtained in the sensitivity magnitude test.

4. Definition

The shape of a dot of a printed image having a density of 0.30 of the printed images obtained in the sensitivity magnitude test was observed with a microscope. The closer to square the shape of one dot is, the higher the definition is.

A: Almost square

B: Round a little

C: Distorted to some extent due to white voids

D: Significantly distorted

The results of the tests are summarized in Table 2.

TABLE 2

Test Results

| | Sensitiveness Magnitude | Rp of Intermediate Layer | Sticking | White Void | Definition |
|---|---|---|---|---|---|
| Ex. 1 | 1.28 | 1.8 | Not observed | A | A |
| Ex. 2 | 1.38 | 0.8 | Not observed | A | A |
| Ex. 3 | 1.35 | 1.2 | Not observed | A | A |
| Ex. 4 | 1.41 | 1.0 | Not observed | A | B |
| Ex. 5 | 1.19 | 2.2 | Not observed | A | A |
| Ex. 6 | 1.21 | 2.0 | Not observed | A | A |
| Ex. 7 | 1.20 | 2.1 | Not observed | A | A |
| Ex. 8 | 1.01 | 5.3 | Not observed | A | B |
| Ex. 9 | 1.21 | 2.3 | Not observed | A | B |
| Ex. 10 | 1.28 | 2.2 | Not observed | A | B |
| Ex. 11 | 1.35 | 1.3 | Not observed | A | B |
| Ex. 12 | 1.38 | 1.5 | Not observed | A | B |
| Ex. 13 | 1.41 | 0.9 | Not observed | A | B |
| Comp. Ex. 1 | 1.00 | 2.2 | Not observed | B | C |
| Comp. Ex. 2 | 1.05 | 6.5 | Observed | C | C |
| Comp. Ex. 3 | 1.00 | 6.8 | Observed | A | B |

EXAMPLE 14

A thermosensitive recording material was obtained in the same manner as in Example 5 except that the amount of the styrene/butadiene copolymer latex in Liquid A was changed to 28 parts.

EXAMPLE 15

A thermosensitive recording material was obtained in the same manner as in Example 5 except that the amount of the styrene/butadiene copolymer latex in Liquid A was changed to 37 parts.

EXAMPLE 16

A thermosensitive recording material was obtained in the same manner as in Example 5 except that the amount of the styrene/butadiene copolymer latex in Liquid A was changed to 48 parts.

EXAMPLE 17

| Preparation of Liquid F | |
|---|---|
| Aqueous dispersion of hollow particles (hollow particle 7 in Table 1, solid content: 30%) | 30 parts |
| Styrene/butadiene copolymer latex (solid content: 47%) | 20 parts |
| 10% Aqueous solution of completely saponified PVA | 1 part |
| Water | 40 parts |

A mixture of the above ingredients was stirred and dispersed to prepare Liquid F.

A thermosensitive recording material was obtained in the same manner as in Example 1 except that Liquid F was used in place of Liquid A.

EXAMPLE 18

A thermosensitive recording material was obtained in the same manner as in Example 17 except that the amount of the 10% aqueous solution of completely saponified PVA was changed to 9 parts.

EXAMPLE 19

A thermosensitive recording material was obtained in the same manner as in Example 1 except that the 20 parts of styrene/butadiene copolymer latex in Liquid A was changed to 36 parts of acrylic emulsion (Almatex E3450 (brand name of Mitsui Toatsu Chemicals, Inc.), solid content: 25%).

EXAMPLE 20

A thermosensitive recording material was obtained in the same manner as in Example 1 except that the amount of the styrene/butadiene copolymer latex in Liquid A was changed to 15 parts.

Comparative Example 4

| Preparation of Liquid G | |
|---|---|
| Aqueous dispersion of hollow particles (hollow particle 11 in Table 1, solid content: 40%) | 30 parts |
| Styrene/butadiene copolymer latex (solid content: 47%) | 15 parts |
| Water | 55 parts |

A mixture of the above ingredients was stirred and dispersed to prepare Liquid G.

A thermosensitive recording material was obtained in the same manner as in Example 1 except that Liquid G was used in place of Liquid A.

Comparative Example 5

A thermosensitive recording material was obtained in the same manner as in Comparative Example 4 except that the amount of the styrene/butadiene copolymer latex in Liquid A was changed to 30 parts.

Evaluation Method

1. Sensitivity Magnitude

Using the test machine, printing was performed on the thermosensitive recording material having a calendered surface under conditions of a head power of 0.45W/dot, a recording time per line of 20 sec/L, and a scanning density of 8×385 dots/mm while changing the pulse width in the range of 0.0–0.7 msec every 1 msec. The density of the printed image was measured with a densitometer RD-914, and the pulse width corresponding to a density of 1.0 was calculated. The sensitivity magnitude was calculated according to the following equation, with reference to the value of Comparative Example 1. The larger the value, the better the sensitivity (thermal responsiveness)

Sensitivity magnitude=(pulse width of measured sample)/(pulse width of Comparative Example 1)

2. Definition

The shape of a dot of a printed image having a density of 0.30 of the printed images obtained in the sensitivity magnitude test was observed with a microscope. The closer to square the shape of one dot is, the higher the definition is.

A: Almost square

B: Round a little

C: Distorted to some extent due to white voids

D: Significantly distorted

The test results are summarized in Table 3.

TABLE 3

Test Results

| | Chlorine atom | Sensitivity | Rp of intermediate layer | Definition |
|---|---|---|---|---|
| Ex. 14 | Not contained | 1.17 | 2.3 | B |
| Ex. 15 | Not contained | 1.15 | 3.3 | B |
| Ex. 16 | Not contained | 1.00 | 5.3 | B |
| Ex. 17 | Not contained | 1.17 | 2.6 | A |
| Ex. 18 | Not contained | 1.15 | 4.2 | A |
| Ex. 19 | Not contained | 1.13 | 3.0 | B |
| Ex. 20 | Not contained | 0.96 | 3.1 | B |
| Comp. Ex. 4 | Contained | 0.98 | 6.1 | C |
| Comp. Ex. 5 | Contained | 0.83 | 5.9 | C |

According to the thermosensitive recording material of the present invention, the hollow particles improves the thermal insulating property of the intermediate layer and thus allows heat from a thermal head to be efficiently transmitted to a surface of the thermosensitive recording material, resulting in high sensitivity of the thermosensitive recording material. The hollow particles can also maintain the surface of the thermosensitive recording material uniform, prevent white voids and sticking and improve uniformity of a printed image. When a hydrophobic emulsion resin is used together with the hollow particles as a binder thereof in an amount of 100–200% based on the amount of the hollow particles, the sensitivity of the thermosensitive recording material can be further improved. Additionally, when a polyvinyl alcohol is added to the intermediate layer in an amount of 1–10% based on the amount of the hollow particles, image definition can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A thermosensitive recording material comprising a support, an intermediate layer provided on said support, and a thermosensitive recording layer provided on said intermediate layer and containing a leuco dye and a color developer for developing said leuco dye upon application of heat, wherein said intermediate layer contains a binder and hollow particles made of a crosslinked polymeric material and having a hollowness of not lower than 60% but not higher than 98%, a maximum particle diameter (D100) of 5.0 to 10,0 μm and a ratio D100/D50 of said maximum particle diameter (D100) to the median volume equivalent particle diameter (D50) in the range of 1.5 to 3.0.

2. A thermosensitive recording material as claimed in claim 1, wherein said hollow particles have such a particle size distribution that particles having a diameter of not greater than 2 μm account for 5 to 10% by volume based on a total volume thereof.

3. A thermosensitive recording material as claimed in claim 1, wherein said crosslinked polymeric material does not contain a halogen atom.

4. A thermosensitive recording material as claimed in claim 1, wherein said crosslinked polymeric material is a polymer or copolymer of a vinyl monomer.

5. A thermosensitive recording material as claimed in claim 1, wherein said crosslinked polymeric material is a copolymer of (a) at least one monofunctional vinyl monomer and (b) at least one polyfunctional vinyl monomer.

6. A thermosensitive recording material as claimed in claim 5, wherein said polyfunctional vinyl monomer is divinylbenzene.

7. A thermosensitive recording material as claimed in claim 5, wherein said monofunctional vinyl monomer is selected from the group consisting of acrylonitrile, methacrylonitrile, an acrylic ester and a methacrylic ester.

8. A thermosensitive recording material as claimed in claim 5, wherein said monofunctional vinyl monomer is a compound represented by the following formula (1):

(1)

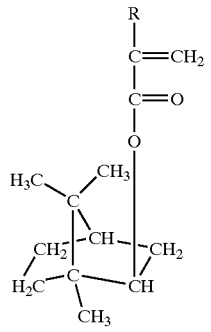

wherein R represents a hydrogen or a methyl group.

9. A thermosensitive recording material as claimed in claim 1, wherein said crosslinked polymeric material is a polymer or copolymer having a skeletal structure containing a structural unit represented by the following general formula (2):

(2)

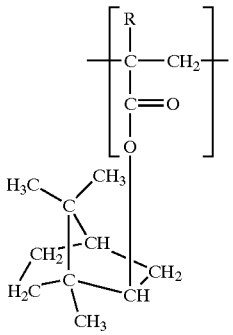

wherein R represents a hydrogen or a methyl group.

10. A thermosensitive recording material as claimed in claim 1, wherein that surface of said intermediate layer which provides an interface between said intermediate layer and said thermosensitive layer has a printing roughness (Rp) of 0.1 to 5.0 $\mu$m.

11. A thermosensitive recording material as claimed in claim 1, wherein said binder of said intermediate layer comprises a hydrophobic resin in an amount of 100–300% based on the weight of said hollow particles.

12. A thermosensitive recording material as claimed in claim 11, wherein said hydrophobic resin is a styrene-butadiene copolymer.

13. A thermosensitive recording material as claimed in claim 11, wherein said binder of said intermediate layer additionally comprises polyvinyl alcohol in an amount of 1–10% based on the weight of said hollow particles.

14. A thermosensitive recording material as claimed in claim 1, wherein said leuco dye comprises at least one compound selected from the group consisting of 3-(N,N-dibutylamino)-6-methyl-7-anilinofluoran, 3-(N-ethyl N-isoamylamino)6-methyl-7-anilinofluoran and 3-[N-ethyl-N-(P-methyphenyl)]-6-methyl-7-anilinofluoran.

15. A thermosensitive recording material as claimed in claim 1, wherein said color developer comprises at least one compound selected from the group consisting of 4,4'-dihydroxydiphenylsulfone, 2,4'-dihydroxydiphenylsulfone, and 4-isopropoxy-4'-hydroxydiphenylsulfone.

16. A thermosensitive recording material comprising a support, an intermediate layer provided on said support, and a thermosensitive recording layer provided on said intermediate layer and containing a leuco dye and a color developer for developing said leuco dye upon application of heat, wherein said intermediate layer comprises a binder and hollow particles of a crosslinked polymeric material which does not contain a halogen atom, said hollow particles having a hollowness of not lower than 60% but not higher than 98%.

* * * * *